US005699401A

United States Patent [19]

Jackson et al.

[11] Patent Number: 5,699,401

[45] Date of Patent: Dec. 16, 1997

[54] ANODE ASSEMBLY FOR USE IN X-RAY TUBES, AND RELATED ARTICLES OF MANUFACTURE

[75] Inventors: Melvin Robert Jackson, Niskayuna; Michael Robert Eggleston, Scotia, both of N.Y.

[73] Assignee: General Electric Company, Schenectady, N.Y.

[21] Appl. No.: 731,445

[22] Filed: Oct. 15, 1996

[51] Int. Cl.[6] ..... H01J 35/10

[52] U.S. Cl. ..... 378/144; 378/125; 445/28

[58] Field of Search ..... 378/125, 144, 378/143; 445/28, 29; 228/193

[56] References Cited

U.S. PATENT DOCUMENTS

| | | | |
|---|---|---|---|
| 3,268,328 | 8/1966 | Torti . | |
| 3,497,402 | 2/1970 | Douglass et al. . | |
| 4,574,388 | 3/1986 | Port et al. . | |
| 5,171,379 | 12/1992 | Kumar et al. . | |
| 5,498,186 | 3/1996 | Benz et al. . | |
| 5,530,733 | 6/1996 | Eggleston et al. | 378/144 X |
| 5,547,410 | 8/1996 | Eggleston et al. | 378/144 X |
| 5,577,093 | 11/1996 | Benz et al. | 378/144 X |

*Primary Examiner*—David P. Porta

*Attorney, Agent, or Firm*—Noreen C. Johnson; William H. Pittman

[57] ABSTRACT

An improved anode assembly for an x-ray tube is described herein. The assembly includes:

(a) a target having a central cavity formed therein;

(b) a tubular stem for connection to the target to form a target/stem assembly;

(c) an insert within the central cavity, shaped to receive a portion of the stem, and comprising a niobium-based alloy; and (d) a rotor body assembly adapted for connection to the target/stem assembly and rotation therewith.

X-ray tubes which incorporate such an anode assembly are also described, as are methods for bonding a target to a tubular stem for use in a rotating x-ray tube.

25 Claims, 3 Drawing Sheets

ANODE ASSEMBLY FOR USE IN X-RAY TUBES, AND RELATED ARTICLES OF MANUFACTURE

TECHNICAL FIELD

This invention relates generally to x-ray generating equipment, and more particularly, to the target/stem assemblies used in such equipment.

BACKGROUND OF THE INVENTION

X-ray equipment is obviously a very important tool for a variety of applications, such as diagnostic and therapeutic radiology. The x-ray tubes usually include three primary elements: a cathode, which serves as the source of electrons; an anode; and some mechanism for applying high voltage to drive the electrons to the anode. The "target" is the portion of the anode where the electron beam makes contact, and the x-rays are generated.

One type of x-ray tube often used in radiology employs a rotary anode, which is usually shaped like a disk. The disk is fixed to a support shaft, which is itself connected to a rotor. The entire assembly is rotated by a rotary magnetic field to which the rotor is exposed. In most cases, the rotary anode is exposed to very high thermal and mechanical stresses. As an example, high mechanical stress can occur with high rotation speed and high acceleration of the anode.

The x-radiation is obtained under the action of electron bombardment of a small surface of the anode. In general, a very small part of the electrical energy used for accelerating the electrons is converted into x-rays. The remainder of the energy is dissipated as heat in the rotary anode. The rotary target (or "rotary anode") is often exposed to very strong thermal shocks, and it can reach very high temperatures. This is especially significant when the x-ray tubes are used in equipment like the computerized axial tomography (CAT) scanners, which often require longer x-ray scanning times. The longer scans generate much greater amounts of heat in the target region, and this heat must eventually be dissipated by the rotating anode.

The connection between the target and the shaft or "stem" is a critical feature for this type of x-ray equipment, since failure of x-ray devices in the field has often been traced to this connection. The mechanical stresses mentioned above can loosen the rotary target, and the entire anode assembly can then become unbalanced. Unacceptable vibration and/or mechanical breakage of the assembly may then occur. The need for a balanced target/stem assembly is also critical during the manufacturing cycle, especially in the case of the larger x-ray targets being used today, e.g., those greater than about 6 inches in diameter. A more frequent occurrence of unbalanced assemblies leads to reduced manufacturing yields.

The manufacturing steps for x-ray tube equipment present challenges in obtaining durable, high quality products. As an example, the target/stem connection must not be adversely affected by vacuum-firing at temperatures up to about 1500° C. Thus, the temperatures used when bonding the materials which constitute the target/stem connection must be low enough to not adversely affect the properties of the materials. One commonly-used alloy for the target and stem is based on the titanium/zirconium-alloyed molybdenum-base material (TZM), and this type of material can lose significant strength at about 2000° C.

Some of the processing steps used in the manufacture of the x-ray tubes are collectively referred to as "thermal-mechanical" techniques. As is well-known in the art, the individual steps can include sintering and forging, as well as high-temperature outgassing treatments (e.g., up to about 1900° C.). Although often necessary, these steps can also adversely affect the integrity of some of the elements in the x-ray tubes, as mentioned above.

The quality and durability of the stem/target assembly for x-ray tubes has been enhanced by the use of inserts. For example, U.S. Pat. No. 5,498,186 (M. Benz et al), describes the use of a ductile metal insert to bond the stem of an x-ray tube to the target. More specifically, the target can be "diffusion-bonded" to the insert, which is then diffusion-bonded to the stem. The insert may be formed from a variety of tantalum-based alloys. U.S. Pat. No. 4,578,388 (J. Port et al) also describes the use of an insert to facilitate connection between a stem and target of an x-ray tube. In that reference, the insert is formed from a molybdenum material, and is preferably made of pure molybdenum.

There certainly do appear to be advantages to using inserts for the stem/target connection, but some drawbacks occur with the current selection of materials for those inserts. As an illustration, some of the tantalum alloys (e.g., tantalum with 10% by weight tungsten) exhibit high temperature strength when used as the insert material. Moreover, this type of alloy does not appear to be susceptible to the undesirable, extreme grain growth which can occur during thermal-mechanical processing of the x-ray target. However, tantalum can be a very expensive material, and its use can therefore significantly increase the cost of producing an x-ray tube.

While molybdenum inserts might be useful for some x-ray tube applications, there also appear to be some associated disadvantages. For example, when an insert of pure molybdenum was tried, the x-ray target exhibited significant grain growth after thermal-mechanical processing. This grain growth can embrittle the insert and thereby degrade the target/stem connection.

It is thus apparent that further improvements in stem/target assemblies for x-ray tubes would be welcome in this field of art. More specifically, for the case in which inserts are used, the inserts should be formed of a material capable of being diffusion-bonded to the stem and target, using thermal-mechanical techniques. The insert material should be one which would allow the thermal-mechanical techniques to be carried out as an integral part of the rotary anode fabrication process. Moreover, the insert material should retain its ductility after the thermal-mechanical processing has been completed, and during use of the x-ray tubes.

Furthermore, the resulting target/stem assembly should be resistant to failure due to imbalance, both during manufacture and in use.

The assembly should also be formed of materials which allow relatively cost-efficient production of the overall x-ray units.

SUMMARY OF THE INVENTION

Many of the needs discussed above have been satisfied by the discovery of an improved anode assembly for an x-ray tube, comprising:

(a) a target having a central cavity formed therein;

(b) a tubular stem for connection to the target to form a target/stem assembly;

(c) an insert within the central cavity, shaped to receive a portion of the stem, and comprising a niobium-based alloy; and (d) a rotor body assembly adapted for connection to the target/stem assembly and rotation therewith.

In preferred embodiments, the niobium-based alloy forming the insert comprises niobium, molybdenum, and optionally, titanium. In some especially preferred embodiments, the alloy further comprises minor amounts of yttrium.

Other embodiments of this invention are directed to an x-ray tube which includes the anode assembly set forth above and further described in the remainder of this specification. Still other embodiments are directed to methods for bonding a target to a tubular stem for use in a rotating x-ray tube, in which the niobium-based insert is inserted into the target, followed by inserting the stem into the target/insert combination. Numerous other details regarding aspects of this invention are provided below.

BRIEF DESCRIPTION OF THE INVENTION

DETAILED DESCRIPTION OF THE INVENTION

X-ray devices are generally well-known in the art and need not be described in exhaustive detail here. Illustrative patents which describe x-ray devices and related technology are as follows: U.S. Pat. Nos. 5,498,186 (Benz. et al); 4,736,400 (Koller et at); 4,670,895 (Penato et al); 4,574,388 (Port et al); and 4,367,556 (Hubner et al). Each of the foregoing patents is incorporated herein by reference. Numerous other references are a source of instructive information regarding x-ray tubes. One example is the *Encyclopedia Americana*, Vol. 29, 1994, Grolier, Inc., pp. 619 et seq.

Figure 1:
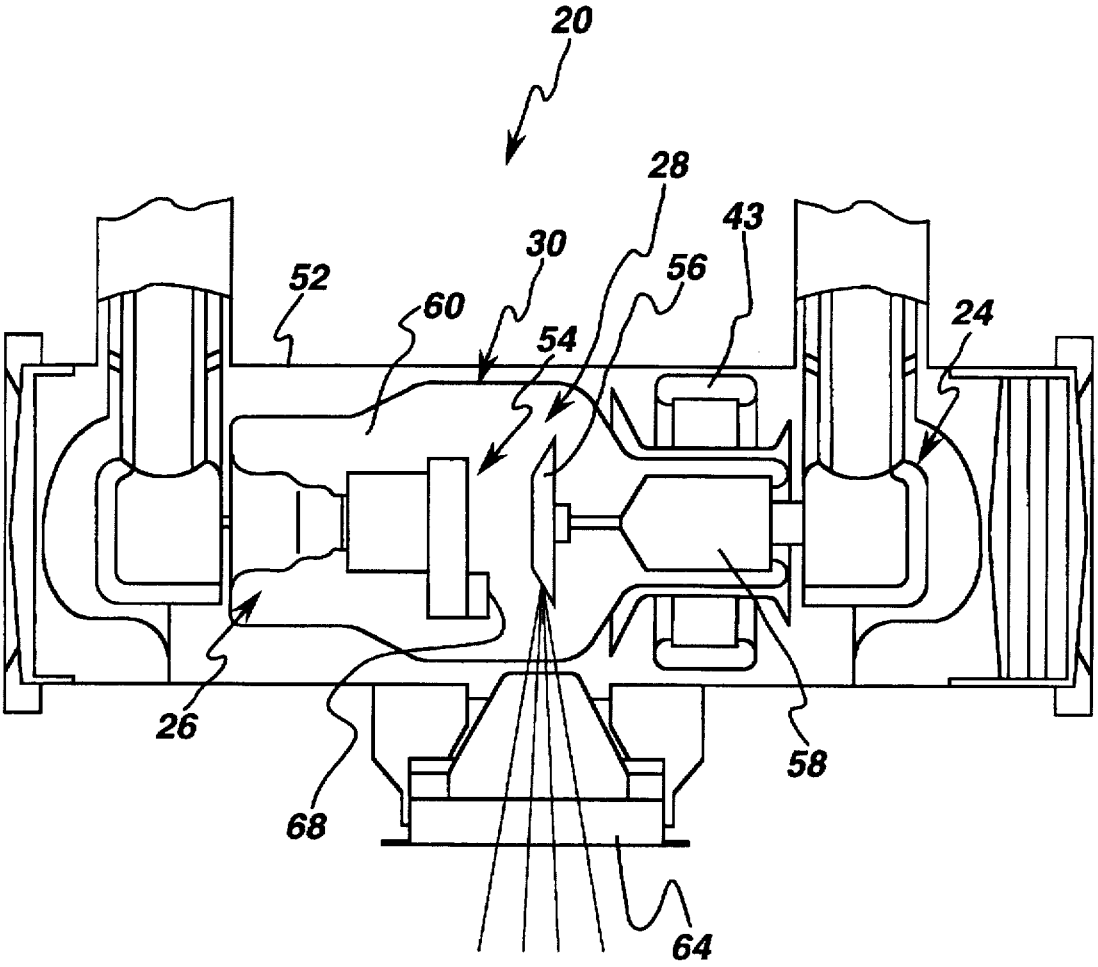
FIG. 1 is a schematic representation of a typical x-ray system, having an x-ray tube positioned therein.

FIG. 1 is a suitable representation of a typical x-ray system 20, generally enclosed in a casing 52. The x-ray system includes an anode end 24, a cathode end 26, and a center section 28 positioned between the anode end and the cathode end. The center section contains the x-ray tube 30. The system further includes a cathode plate 54, a rotating target 56, and a rotor 58, which is enclosed in a glass envelope 60. A window 64 for emitting the x-rays is formed in the casing 52, in a position relative to target 56, so that x-rays can exit the x-ray system. As described in the referenced U.S. Pat. No. 5,498,186, the system usually includes other features which don't require elaboration here, e.g., a radiator. The casing is usually filled with oil, to absorb the heat produced by the x-rays.

Figure 2:
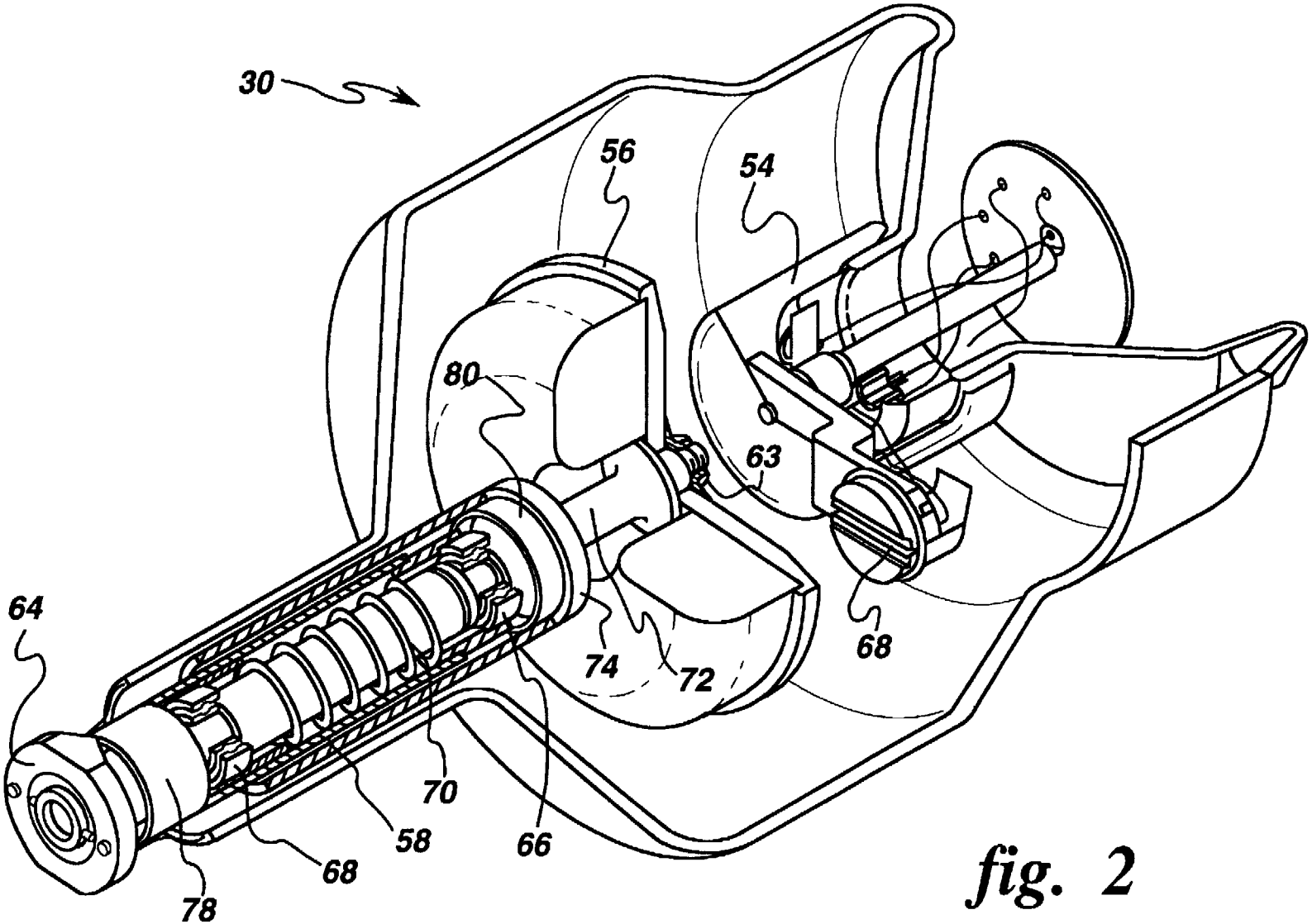
FIG. 2 is a partial perspective view of a representative x-ray tube, with parts removed, parts in section, and parts broken away.

With reference to FIG. 2, cathode 54 is positioned inside the glass envelope 60, within a vacuum. As is well-known, electrical energy generates x-rays that are aimed from the cathode filament 68 to the top of the target 56. The target is usually connected to a rotating shaft 61 by conventional mechanisms. Here, for example, a Belleville nut 63 fastens one end of the shaft to the target, while another nut is used to hold end 64 of the shaft in place. Front beating 66 and rear beating 67 are operatively positioned on the shaft 61, and are also fastened conventionally.

Preload spring 70 is positioned about shaft 61 between the bearings 66 and 67. It maintains the load on the bearings during expansion and contraction of the anode assembly. A rotor stem (stud) 72 is used to space the end of the rotor most proximate the target 56 from the rotor hub 74. Beatings 66 and 67 are held in place by retainers 80 and 78. The rotor body assembly also includes a stem ting and a stem, all of which help to provide for the rotation of the rotor 58 with the target 56.

High temperatures can occur in various sections of the x-ray system during operation. As an example, the temperature in the area of filament 68 can approach about 2500° C., while the temperature near the center of the rotating target 56 can approach about 1100° C. Temperatures at the focal spot of the target 56 could reach about 3200° C. When the system is used at peak power or in a continuous type of operation, the large amount of heat generated can damage some of the elements described above, such as bearings 66 and 67. Moreover, the cycle of rapid acceleration of the rotating target (e.g., to speeds of about 10,000 rpm) and immediate braking of the rotation also creates mechanical and thermal stress on the rotor 58 and the target/stem-rotor assembly connection. This stress can lead to the anode assembly imbalance mentioned above, which is believed to be the leading cause of many x-ray tube failures. More specifically, the imbalance-problems are thought to be caused by adverse changes which occur in the connection between target 56/stem assembly 72 and the rotor 58.

Figure 3:
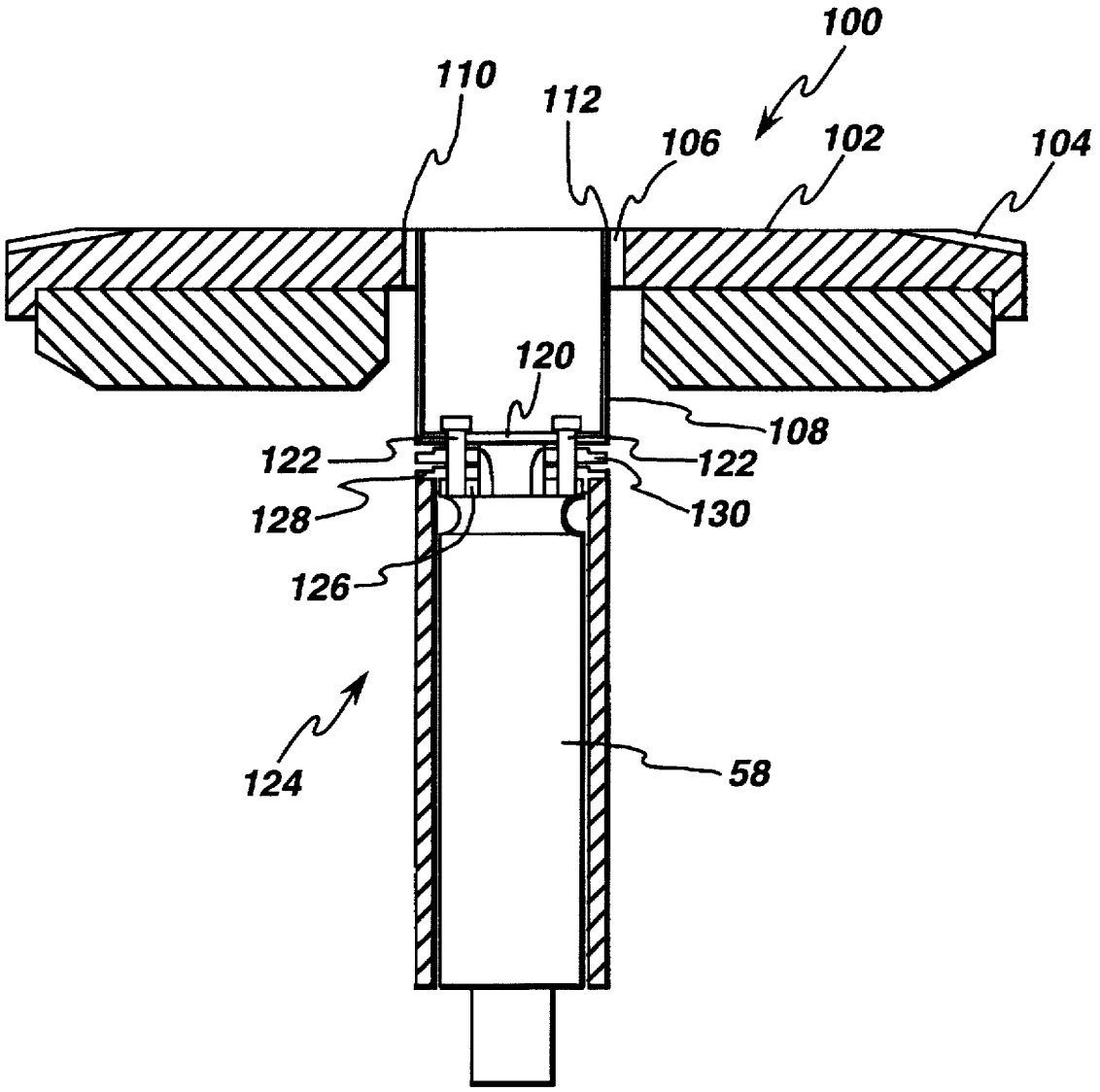
FIG. 3 is a sectional view of the target/stem assembly for an x-ray tube, including features associated with the present invention.

FIG. 3 depicts a representative anode assembly according to the present invention. It is generally designated as reference numeral 90, and includes a target/stem assembly 100 and a rotor body assembly 124. The target/stem assembly includes target 102. Assembly 100 also includes a focal track 104 (connected to the target by standard metallurgical techniques), which reflects the x-rays generated by the cathode 68 through the window 64, as previously shown in FIG. 1.

The target 102 is preferably formed of a powder-metallurgy-alloy. Suitable materials are known in the art, and are those which are compatible with known fabrication steps for target manufacture, e.g., powder making, die pressing, sintering, forging, annealing, and coating or brazing to a graphite back 103. Often, the target is made of a molybdenum alloy like the above-mentioned TZM (titanium-zirconium-molybdenum).

Stem 108 is also a well-known element of these types of x-ray tubes. It is usually tubular in shape, and can be made from metals or metal alloys capable of maintaining the bond between the tubular stem and the target for at least about 40,000 scan seconds, as described in U.S. Pat. No. 5,498,186 of Benz et al. Niobium or niobium-based alloys are preferred materials for stem construction, as described in Benz et al.

In preferred embodiments, the stem has a large bore and a thin-wall. For example, the bore diameter is usually about 15% to about 40% of the target diameter; and the wall of the stem usually has a thickness of about 25 mils to about 50 mils. The Benz et al patent describes some advantages of this type of stem construction, such as strength and stiffness during bending and torsion (as compared to smaller-diameter stems); and control over thermal resistance.

The anode assembly of the present invention includes an insert 106, which lines a central cavity within target 102. The insert is to be diffusion-bonded to stem 108, and is preferably co-processed with the target during its manufacture. The insert has a wall thickness which is preferably about 0.5% to about 5% of the diameter of the target.

In the present invention, insert 106 comprises a niobium-based alloy. (Niobium is sometimes referred to in the art as "columbium"). In preferred embodiments, the alloy comprises niobium and molybdenum. Thus, an illustrative alloy suitable for use as an insert would comprise about 60% to about 95% niobium and about 5% to about 40% molybdenum, based on weight.

In some particularly preferred embodiments, the insert alloy further comprises titanium. The titanium helps to increase the ductility of the alloy. Its presence also adds some oxygen-tolerance for the processing of the alloy, since it tends to getter oxygen. Moreover, the titanium can help to control the sintering or recrystallization behavior of the alloy composition for the insert. For example, the titanium can lower the melting point of the alloy composition so that it can be processed at lower temperatures, resulting in lower equipment and/or energy costs.

When used, the titanium is usually present at a level in the range of about 0.5% by weight to about 15% by weight, and preferably, at a level in the range of about 5% by weight to about 10% by weight. Thus, the alloy can be formed of a composition comprising about 40% to about 95% niobium; about 5% to about 40% molybdenum; and about 0.5% to about 15% titanium, based on the total weight of the alloy. In many preferred embodiments, the composition is about 65% to about 85% niobium; about 10% to about 25% molybdenum; and about 5% to about 10% titanium.

In other embodiments of this invention, the insert alloy for the anode assembly further comprises about 0.001% to about 1% yttrium, based on the total weight of the alloy, and preferably, about 0.01% to about 0.2% yttrium. The yttrium functions as a stabilizer to prevent excessive grain growth in response to deformation and subsequent elevated temperature-exposure. Thus, the alloy could comprise about 40% to about 95% niobium; about 5% to about 40% molybdenum; about 0.5% to about 15% titanium; and about 0.001% to about 1.0% yttrium, based on weight. Again, in some of the preferred embodiments, the component levels are as follows: about 65% to about 85% niobium; about 10% to about 25% molybdenum; about 5% to about 10% titanium, and about 0.01% to about 0.2% yttrium, all based on the total weight of the insert alloy. As described in U.S. Pat. Nos. 5,171,379 and 3,268,328, the yttrium could be utilized in a variety of forms, such as yttrium oxide, yttrium nitride, or yttrium silicide. (Those references relate in part to the grain-stabilization of tantalum, but the teaching is relevant to the present invention). On a weight basis, a greater amount of the nitride- or silicide-forms of yttrium would be required—usually up to about twice the weight as compared to using yttrium oxide.

Moreover, other chemical stabilizers could be used in place of yttrium. As an example, a variety of rare earth metals (or their oxides) could be used, such as cerium, neodymium, or lanthanum. These materials would usually be employed at the levels of yttrium mentioned above (or in the case of the oxides, at the level used for yttrium oxide.) However, those of ordinary skill in the metallurgical and ceramic arts can determine the most appropriate level for each of these materials, based on various factors, such as the amount of grain-stabilization required, and the resulting properties of the overall alloy composition.

The insert alloys specified for this invention are able to maintain small grain size, high strength, and good ductility during the combination of process steps utilized during the manufacture of the target, e.g., after thermal-mechanical processing at temperatures of up to about 1900° C. The fabrication steps include operatively connecting insert 106 to the internal portion of the target 102, along seam 110. Thus, as further described below, the insert can be diffusion-bonded to the stem by using the same processing techniques employed in the overall anode fabrication process. This represents a very important production advantage for commercially assembling x-ray tubes.

Most of the particular techniques for preparing anode assemblies based on the present invention are not especially critical, although the niobium-based alloy used for insert 106 provides advantages for various processing steps, like diffusion-bonding and sintering. General assembly techniques for anode assemblies and x-ray tubes can be found in the above-referenced U.S. Pat. Nos. 4,736,400 and 4,670,895.

Other techniques suitable for this invention are found in the previously-referenced U.S. Pat. No. 5,498,186 of Benz et al. In reference to FIG. 3 for this invention, tubular stem 108 can be press-fitted into the insert 106 so that sufficient pressure between the two for diffusion-bonding (a well-known technique) is provided. Bonding between the tubular stem and target via the insert can be accomplished by vacuum annealing for a sufficient time (usually about 2 to 4 hours) at a sufficient temperature (,preferably higher than about 1150° C.) and at a sufficient contact pressure (preferably greater than about 10,000 psi) to effect diffusion.

The selection of materials for the tubular stem and the insert allows for a situation in which the coefficient of thermal expansion of the stem material is greater than the coefficient of thermal expansion of the insert material, which is in turn greater than the coefficient of thermal expansion of the target material. These differences in expansion result in compressive pressure between the various components as the temperature increases. This in turn ensures intimate contact between the various components at the bonding temperature, which is a prerequisite for good bonding.

In some relevant manufacturing processes, the first step in fabricating the target/stem combination involves pressing and sintering the target (usually made of TZM) at about 2200° C. in vacuum, or at a conventional temperature. The target is then forged at about 1400° C. to about 1600° C. A stress-relief anneal can then be performed at a temperature of about 1500° C. to about 1900° C. in a vacuum, followed by machining of the target. If necessary, the target can then be labeled, inspected, and cleaned. Sometimes, graphite is brazed to the target, followed by a final machining and a final heat treatment. As shown in FIG. 2, the stem 72 can then be attached to the target 56 by washer 63.

Variations on these fabrication steps are possible, as shown, for example, in the Benz et al patent. As an illustration, the target can be machined to accept a tubular stem with a light press-fit. The bottom plate 120 (FIG. 3) can be machined separately and then connected to the stem. This connection can advantageously be made by electron beam (EB) welding.

In these variations on fabrication, the target can be forged, and the insert can then be inserted into the target, followed by a stress relief anneal at about 1500° C. to about 1900° C., for diffusion bonding of the insert to the target. Next, the target/insert combination is machined, followed, optionally, by the labeling/inspection/cleaning and graphite-brazing steps mentioned above. Additional machining of the target/insert combination can then be carried out if desired.

Separately, the tubular stem 108 (usually of the large bore, thin-wall type, and made from an alloy such as one based on niobium) is inserted into the target/insert combination. There, it undergoes a final heat treatment at about 1200° C. to about 1600° C., to form the target/stem assembly.

As described in the Benz et al patent, other alternative methods for forming the target/insert combination are possible. As an example, the target in powder form can be pressed and sintered with the insert in powder form, in a single step. The combination can then be forged at about 1400° C. to about 1700° C., followed by a stress relief anneal at about 1500° C. to about 1900° C., and machined. The tubular stem can then be inserted as described in the Benz et al patent, wherein various specific techniques for attaching the stem to the target/insert combination are provided. That reference also provides other instructive details regarding suggested sequences for processing the materials; coating of the insert (i.e., with a consumable braze or diffusion enhancer); and suggested, appropriate dimensions for the diameter and wall thickness of the tubular stem.

The attachment of the target/stem assembly to the rotor body assembly can also be carried out by known techniques, as described in the Benz et al patent. With reference to FIG. 3, the flat bottom plate 120 can be attached to the end of stem 108, which then attaches to rotor body assembly 124. For ductile materials, this plate 120 could be welded into place prior to the attachment of stem 108 to the target/insert combination. The plate serves as support for mechanical fasteners 122. In one embodiment, plate 120 can be EB-welded to stem 108. Holes can be drilled into the plate for connection to the rotor body assembly.

Rotor body assembly 124 typically includes a bearing hub 126 at one end (usually made of a high-temperature alloy like those based on nickel), and a rotor hub 128 positioned between the bearing hub and the bottom plate 120. One or more thermal barrier washings 130 (usually made from refractory metals, superalloys, or ceramics having low thermal conductivity) can be inserted to limit the amount of heat which is transferred from target/stem assembly 100 to rotor body assembly 124.

Fasteners may be used to operatively connect rotor body assembly 124 to target/stem assembly 100, as described in the Benz et al patent. In one suggested technique, threaded fasteners, made of TZM, a nickel-based alloy, or a niobium alloy, could be passed through bottom plate 120, through thermal barrier washer 130 and rotor hub 128, and into threaded portions in the beating hub (not shown). Other details regarding fasteners, washer design, and alignment between the target/stem assembly and the rotor body assembly are provided in the Benz et al patent.

In regard to the topic of alignment, it is noted that x-ray tubes made in accordance with the present invention are able to maintain long term anode assembly balance, which results in greater durability for the equipment. This balance is ensured in part because of the accurate alignment between target/stem assembly 100 and rotor body assembly 124, shown in FIG. 3. One means of achieving such accuracy is by making sure that the surface of each assembly which contacts the other assembly is machined, flat, and parallel. Thus, when the target/stem assembly 100 and the rotor body assembly 124 are assembled together, the top of the target 102 is parallel to all of the contacting surfaces, within specified tolerances of, for example, 0.001 inches. Moreover, the contacting surfaces parallel to the anode assembly (as shown in FIG. 8 of U.S. Pat. No. 5,498,186 and discussed therein) are machined to very tight tolerances of, for example, 0.0005 inches. These surfaces ensure the alignment and concentricity of the combination target/stem assembly and the rotor body assembly with respect to the target.

It should be clear from the foregoing that another aspect of the present invention embraces an improved x-ray tube, comprising:

(i) a glass envelope;

(ii) a cathode assembly, operatively positioned in the glass envelope; and (iii) an anode assembly, which itself comprises:

(a) a target having a central cavity formed therein;

(b) a tubular stem for connection to the target to form a target/stem assembly;

(c) an insert within the central cavity, shaped to receive a portion of the stem, and comprising a niobium-based alloy; and (d) a rotor body assembly adapted for connection to the target/stem assembly and rotation therewith.

In preferred embodiments, the alloy used to form the insert comprises components in the ranges discussed above, e.g., about 40% to about 95% niobium; about 5% to about 40% molybdenum; and about 0.5% to about 15% titanium, based on the total weight of the alloy. In some especially preferred embodiments, the alloy further comprises about 0.001% by weight to about 1% by weight yttrium. These x-ray tubes are expected to be very durable and reliable under severe manufacturing and operating conditions, due in large part to the presence of the improved anode assembly described previously.

Still another aspect of the present invention is directed to an improved method for bonding a target to a tubular stem for use in a rotating x-ray tube, comprising the steps of:

(I) inserting an insert comprised of a niobium alloy into the target;

(II) annealing the combined target/insert;

(III) inserting a tubular stem into the target/insert;

(IV) heat-treating the stem/target combination under conditions sufficient to diffusion-bond the insert into the target and into the tubular stem; and (V) connecting the target/stem assembly to a rotor body assembly.

Details regarding the various fabrication steps have been provided above, and in the noted references. Particular types of ductile, niobium-based insert alloys for this invention have also been discussed. A key advantage of the process based in part on using this type of insert is that the insert can be electron-beam welded to the stem, acting as a redundant form of attachment between the target and the stem, without excessive embrittlement of the material. Moreover, the insert material can be pressed and sintered as an integral pan of the target manufacturing process, as described previously.

In a more-specific embodiment, a method for bonding a target to a tubular stem for use in a rotating x-ray tube is disclosed, comprising the steps of:

(a) pressing and sintering the target;

(b) forging the target at a temperature of about 1400° C. to about 1700° C.;

(c) providing a machined insert comprised of a niobium alloy;

(d) inserting the insert into the target;

(e) stress relief-annealing the combined target/insert from a temperature of about 1500° C. to about 1900° C.;

(f) machining the combined target/insert;

(g) providing a tubular stem;

(h) providing a bottom plate;

(i) connecting the bottom plate to the tubular stem;

(j) inserting the tubular stem into the target/insert combination;

(k) final heat-treating the stem/target combination from about 1200° C. to about 1600° C. for a time sufficient to diffusion-bond the insert into the target and into the tubular stem, wherein the coefficient of thermal expansion of the stem material is greater than the coefficient of thermal expansion of the insert material, which is in turn greater than the coefficient of thermal expansion of the target material; and (1) connecting the target/stem assembly to a rotor body assembly.

As mentioned previously, there are quite a few variations on this process, and they fall within the scope of this invention. For example, one desirable alternative would include co-pressing and co-sintering the target and the insert, i.e., while the two components are attached. This would eliminate steps (c) and (d) above, streamlining the process. Another alternative which is sometimes favored involves carrying out steps (c) and (d) before step (b), i.e., forging after the insert is in place. This sequence allows both the forging step and the stress-relief annealing step to enhance bonding between the insert and the target. Again, other details regarding this embodiment are found above, or in the references made of record herein.

EXAMPLE

This example is merely illustrative, and should not be construed to be any sort of limitation on the scope of the claimed invention.

Three test samples were prepared. Each was in the shape of a button, i.e., a 0.75 inch-diameter fight-circular cylinder, having a thickness of approximately 0.5 inch. Sample 1 was a commercial material formed of a pure (wrought) molybdenum alloy, and sample 2 was formed (by powder metallurgy techniques) of a standard TZM alloy (0.5% titanium, 0.1% zirconium, with the balance being molybdenum), by sintering at 2000° C. in a vacuum and then forging out of an argon furnace. Sample 3 was formed of a material suitable for use as the target insert for the present invention. It was prepared in the same way as sample 2, using standard powder metallurgy techniques, and it contained approximately 77.3% niobium, 17.3% molybdenum, and 5.4% titanium, by weight.

Each sample was heated to 1850° C. in vacuum for 3 hours. Sample 1 (pure molybdenum) experienced extreme grain growth. A few fine grains remained after the heat treatment, but most of the surface consisted of several very large grains. For body cubic-centered metals like molybdenum, room-temperature ductility is inversely proportional to grain size. Therefore, the large grain structure obtained would be expected to possess very limited room-temperature ductility. This is a disadvantage if the alloy is to be treated or processed at room temperature, e.g., being machined.

Samples 2 and 3 both retained a uniform, fine grain structure, which should provide a desirable combination of strength and ductility. However, sample 3 should exhibit greater ductility at room temperature, as compared to the TZM-based sample 2. Sample 3 should also exhibit better "formability" than sample 2, at intermediate temperatures (e.g., about 800° C. to about 1400° C.). Therefore, a greater variety of techniques, such as welding, diffusion bonding, swaging, and mechanical fastening, can be used to connect the target to the shaft when the insert is prepared from a material like that of sample 3.

It should be noted that the starting grain structures for each sample were not identical, and absolute comparisons regarding the change in structure cannot be made here. However, the results generally do indicate the benefits of using niobium-based alloys for target inserts.

While preferred embodiments have been set forth for the purpose of illustration, the foregoing description should not be deemed to be a limitation on the scope of the invention. Accordingly, various modifications, adaptations, and alternatives may occur to one skilled in the art without departing from the spirit and scope of the present invention.

All of the patents, articles, and texts mentioned above are incorporated herein by reference. The various quantities and percentages presented in the patent application are expressed in terms of weight values, unless otherwise indicated.

What is claimed:

1. An anode assembly for an x-ray tube, comprising:

(a) a target having a central cavity formed therein;

(b) a tubular stem for connection to the target to form a target/stem assembly;

(c) an insert within the central cavity, shaped to receive a portion of the stem, and comprising a niobium-based alloy; and (d) a rotor body assembly adapted for connection to the target/stem assembly and rotation therewith.

2. The anode assembly of claim 1, wherein the niobium-based alloy comprises niobium and molybdenum.

3. The anode assembly of claim 2, wherein the alloy comprises about 60% to about 95% niobium and about 5% to about 40% molybdenum, based on weight.

4. The anode assembly of claim 3, wherein the alloy further comprises about 0.001% to about 1% yttrium.

5. The anode assembly of claim 1, wherein the niobium-based alloy comprises niobium, molybdenum, and titanium.

6. The anode assembly of claim 5, wherein the alloy comprises about 40% to about 95% niobium; about 5% to about 40% molybdenum; and about 0.5% to about 15% titanium, based on the total weight of the alloy.

7. The anode assembly of claim 5, wherein the alloy further comprises about 0.001% to about 1% by weight yttrium.

8. The anode assembly of claim 6, wherein the alloy comprises about 65% to about 85% niobium; about 10% to about 25% molybdenum; and about 5% to about 10% titanium.

9. The anode assembly of claim 8, wherein the alloy further comprises about 0.001% to about 1.0% by weight yttrium.

10. The anode assembly of claim 1, wherein the tubular stem comprises a niobium alloy.

11. An x-ray tube, comprising:

(i) a glass envelope;

(ii) a cathode assembly, operatively positioned in the glass envelope; and (iii) an anode assembly, which itself comprises:

(a) a target having a central cavity formed therein;

(b) a tubular stem for connection to the target to form a target/stem assembly;

(c) an insert within the central cavity, shaped to receive a portion of the stem, and comprising a niobium-based alloy; and (d) a rotor body assembly adapted for connection to the target/stem assembly and rotation therewith.

12. The x-ray tube of claim 11, wherein the niobium-based alloy of component (c) comprises niobium and molybdenum.

13. The x-ray tube of claim 11, wherein the niobium-based alloy of component (c) comprises niobium, molybdenum, and titanium.

14. The x-ray tube of claim 13, wherein the niobium-based alloy of component (c) comprises about 40% to about 95% niobium; about 5% to about 40% molybdenum; and about 0.5% to about 15% titanium, based on the total weight of the alloy.

15. The x-ray tube of claim 13, wherein the niobium-based alloy of component (c) further comprises yttrium.

16. The x-ray tube of claim 15, wherein the yttrium is present at about 0.001% to about 1% by weight, based on the total weight of the alloy.

17. An improved method for bonding a target to a tubular stem for use in a rotating x-ray tube, comprising the steps of:

(I) inserting an insert comprised of a niobium alloy into the target;

(II) annealing the combined target/insert;

(III) inserting a tubular stem into the target/insert;

(IV) heat-treating the stem/target combination under conditions sufficient to diffusion-bond the insert into the target and into the tubular stem; and (V) connecting the target/stem assembly to a rotor body assembly.

18. The method of claim 17, wherein the insert recited in step (I) is formed of an alloy which comprises niobium and molybdenum.

19. The method of claim 17, wherein the insert recited in step (I) is formed of an alloy which comprises niobium, molybdenum, and titanium.

20. The method of claim 19, wherein the insert recited in step (I) is formed of an alloy which comprises about 40% to about 95% niobium; about 5% to about 40% molybdenum; and about 0.5% to about 15% titanium, based on the total weight of the alloy.

21. The method of claim 19, wherein the insert alloy further comprises yttrium.

22. The method of claim 21, wherein the yttrium is present at about 0.001% to about 1% by weight, based on the total weight of the alloy.

23. A method for bonding a target to a tubular stem for use in a rotating x-ray tube, comprising the steps of:

(a) pressing and sintering the target;

(b) forging the target at a temperature of about 1400° C. to about 1700° C.;

(c) providing a machined insert which comprises a niobium alloy;

(d) inserting the insert into the target;

(e) stress relief-annealing the combined target/insert from a temperature of about 1500° C. to about 1900° C.;

(f) machining the combined target/insert;

(g) providing a tubular stem;

(h) providing a bottom plate;

(i) connecting the bottom plate to the tubular stem;

(j) inserting the tubular stem into the target/insert combination;

(k) final heat-treating the stem/target combination from about 1200° C. to about 1600° C. for a time period sufficient to diffusion-bond the insert into the target and into the tubular stem, wherein the coefficient of thermal expansion of the stem material is greater than the coefficient of thermal expansion of the insert material, which is in turn greater than the coefficient of thermal expansion of the target material; and (l) connecting the stem/target assembly to a rotor body assembly.

24. The method of claim 23, wherein the insert of step (c) comprises about 40% to about 95% niobium; about 5% to about 40% molybdenum; and about 0.5% to about 15% titanium, based on the total weight of the alloy.

25. The method of claim 23, wherein steps (c) and (d) are carried out before step (b); and step (b) then comprises forging the combined target/insert.

* * * * *